US011001963B2

(12) United States Patent
Fujishita

(10) Patent No.: US 11,001,963 B2
(45) Date of Patent: May 11, 2021

(54) METHOD FOR MANUFACTURING SYNTHETIC LEATHER

(71) Applicant: DIC Corporation, Tokyo (JP)

(72) Inventor: Norie Fujishita, Osaka (JP)

(73) Assignee: DIC CORPORATION, Tokyo (JP)

( * ) Notice: Subject to any disclaimer, the term of this patent is extended or adjusted under 35 U.S.C. 154(b) by 0 days.

(21) Appl. No.: 16/646,498

(22) PCT Filed: Aug. 9, 2018

(86) PCT No.: PCT/JP2018/029885

§ 371 (c)(1),
(2) Date: Mar. 11, 2020

(87) PCT Pub. No.: WO2019/054104

PCT Pub. Date: Mar. 21, 2019

(65) Prior Publication Data

US 2020/0224362 A1 Jul. 16, 2020

(30) Foreign Application Priority Data

Sep. 14, 2017 (JP) ..... JP2017-176696

(51) Int. Cl.
*D06N 3/14* (2006.01)

(52) U.S. Cl.
CPC ..... *D06N 3/14* (2013.01); *D06N 2201/02* (2013.01)

(58) Field of Classification Search
CPC ..... D06N 3/14; D06N 2201/02
See application file for complete search history.

(56) References Cited

U.S. PATENT DOCUMENTS 5,352,711 A 10/1994 DesMarais
2004/0121113 A1 6/2004 Mobley et al.
(Continued)

FOREIGN PATENT DOCUMENTS

CN 104497258 A 4/2015
GB 1244429 A 9/1971
(Continued)

OTHER PUBLICATIONS

Methyl cellulose. ChemicalBook. http://www.chemicalbook.com/ChemicalProductProperty_EN_CB3474718.htm (Year: 2017).*
(Continued)

*Primary Examiner* — Dah-Wei D. Yuan
*Assistant Examiner* — Kristen A Dagenais-Englehart
(74) *Attorney, Agent, or Firm* — McDermott Will & Emery LLP

(57) ABSTRACT

The present invention is to provide a method for manufacturing synthetic leather in which, after obtaining a thickened liquid by adding a thickening agent (B) with an oxyethylene group content of $2\times10^{-2}$ mol/g or less to an aqueous urethane resin composition containing an aqueous urethane resin (A) having an acid value of 0.01 mgKOH/g or higher in a range of 0.01 to 30 parts by mass relative to 100 parts by mass of the aqueous urethane resin (A), the thickened liquid is coated on a base and coagulated with a coagulating agent (C) containing a metal salt (c-1). As the thickening agent, it is preferable to use one or more kinds of thickening agent that is selected from the group consisting of a cellulose thickening agent, an acryl thickening agent, and a urethane thickening agent. Furthermore, as the metal salt (c-1), calcium nitrate is preferable.

2 Claims, 1 Drawing Sheet

(56) References Cited

U.S. PATENT DOCUMENTS

| | | | | |
|---|---|---|---|---|
| 2006/0189240 | A1 | 8/2006 | Taylor et al. | |
| 2007/0204381 | A1 | 9/2007 | Thompson et al. | |
| 2009/0247671 | A1* | 10/2009 | Hong | D06N 3/0059 524/25 |
| 2011/0209504 | A1 | 9/2011 | Thompson et al. | |
| 2014/0163164 | A1 | 6/2014 | Nagahama et al. | |
| 2016/0073713 | A1 | 3/2016 | Takata | |
| 2016/0206432 | A1 | 7/2016 | Tetsui | |
| 2016/0208432 | A1* | 7/2016 | Tetsui | C08G 18/0823 |
| 2017/0156422 | A1 | 6/2017 | Honjo | |
| 2018/0208722 | A1* | 7/2018 | Tetsui | C08J 5/04 |
| 2019/0276629 | A1 | 9/2019 | Fujishita | |

FOREIGN PATENT DOCUMENTS

| | | | |
|---|---|---|---|
| JP | S60-122760 | A | 7/1985 |
| JP | H02-19503 | A | 1/1990 |
| JP | 2000-160484 | A | 6/2000 |
| JP | 2001-011254 | A | 1/2001 |
| JP | 2001-123306 | A | 5/2001 |
| JP | 2002-249985 | A | 9/2002 |
| JP | 2005-273083 | A | 10/2005 |
| JP | 2006-096852 | A | 4/2006 |
| JP | 2006-511727 | A | 4/2006 |
| JP | 2006-524754 | A | 11/2006 |
| JP | 2009-527658 | A | 7/2009 |
| JP | 2010-215903 | A | 9/2010 |
| JP | 2013-023691 | A | 2/2013 |
| JP | 2013-060683 | A | 4/2013 |
| JP | 2013-083031 | A | 5/2013 |
| JP | 2016-060970 | A | 4/2016 |
| JP | 2017-025423 | A | 2/2017 |
| JP | 2017-036516 | A | 2/2017 |
| JP | 2017-105917 | A | 6/2017 |
| JP | 2017-106152 | A | 6/2017 |
| WO | 2015/146334 | A1 | 10/2015 |
| WO | 2017/013926 | A1 | 1/2017 |
| WO | WO-2017013926 | A1 * | 1/2017 ..... D06M 15/71 |

OTHER PUBLICATIONS

International Search Report issued in corresponding International Patent Application No. PCT/JP2018/029885, dated Nov. 6, 2018, with English translation.

International Search Report issued in corresponding International Patent Application No. PCT/JP2017/016302, dated Aug. 1, 2017, with English Translation.

International Search Report issued in corresponding International Patent Application No. PCT/JP2018/029886, dated Sep. 11, 2018, with English Translation.

International Search Report issued in corresponding International Patent Application No. PCT/JP2017/016301, dated Jul. 25. 2017, with English Translation.

Extended European Search Report issued in corresponding European Patent Application No. 188559645, dated Oct. 12, 2020.

* cited by examiner

METHOD FOR MANUFACTURING SYNTHETIC LEATHER

CROSS REFERENCE TO RELATED APPLICATIONS

This patent application is the U.S. National Phase under 35 U.S.C. § 371 of International Application No. PCT/JP2018/029885, filed on Aug. 9, 2018, which claims the benefit of Japanese Patent Application No. 2017-176696, filed on Sep. 14, 2017, the entire contents of each are hereby incorporated by reference.

TECHNICAL FIELD

The present invention relates to a method for manufacturing synthetic leather.

BACKGROUND ART

While the regulations on the use of an organic solvent including dimethyl formamide (DMF) gain momentum in Europe or China, the change from an existing solvent-based urethane resin composition to an aqueous urethane resin composition is also in progress in the field of synthetic leather.

For processing the aqueous urethane resin composition, a method of forming a porous structure by carrying out a specific treatment is widely used for the purpose of improving touch feeling, impact resistance, or the like of synthetic leather. For example, in PTL 1, a method of forming a porous structure by carrying out a heating treatment by using wet heat and microwave in combination after coating an aqueous urethane resin composition on a base; in PTL 2, a method of porosifying an aqueous urethane resin composition by a wet heating using steam or a heating using high-frequency heating or high-frequency dielectric heating in combination; and in PTL 3, a method of forming a porous structure by performing a thermal gelling treatment after immersing an aqueous urethane resin composition in a fibrous base; or the like are disclosed.

Other than those described above, a method of forming a porous coating film by performing coagulation, drying, or the like after allowing an aqueous urethane resin composition to enclose foams by mechanical foaming or the like is disclosed (for example, see PTLs 4 to 7).

The above-described documents are mere examples, and, other than those, a great deal of research and investment is carried out to achieve the porosification of an aqueous urethane resin composition. However, it is still not possible to form a porous structure without undergoing a complex treatment like heating, foaming process, or the like.

CITATION LIST

Patent Literature

PTL 1: JP-A-2000-160484
PTL 2: JP-A-2002-249985
PTL 3: JP-A-2013-083031
PTL 4: JP-A-2005-273083
PTL 5: JP-T-2006-511727
PTL 6: JP-T-2006-524754
PTL 7: JP-T-2009-527658

SUMMARY OF INVENTION

Technical Problem

The problem to be solved by the present invention is to provide a method for manufacturing synthetic leather with excellent touch feeling by conveniently forming, without undergoing processes like heating or foaming, a urethane resin layer with a porous structure by using an aqueous urethane resin composition.

Solution to Problem

The present invention is to provide a method for manufacturing synthetic leather in which, after obtaining a thickened liquid by adding a thickening agent (B) with an oxyethylene group content of $2\times10^{-2}$ mol/g or less to an aqueous urethane resin composition containing an aqueous urethane resin (A) having an acid value of 0.01 mgKOH/g or higher in a range of 0.01 to 30 parts by mass relative to 100 parts by mass of the aqueous urethane resin (A), the thickened liquid is coated on a base and coagulated in a coagulation bath (C) containing a metal salt (c-1).

Advantageous Effects of Invention

According to the manufacturing method of the present invention, with an aqueous urethane resin composition, a urethane resin layer with a porous structure can be conveniently formed without undergoing processes such as heating or foaming, and thus synthetic leather with excellent touch feeling can be obtained. Furthermore, in the present invention, the term "porous" means having many small holes.

DESCRIPTION OF EMBODIMENTS

Figure 1:
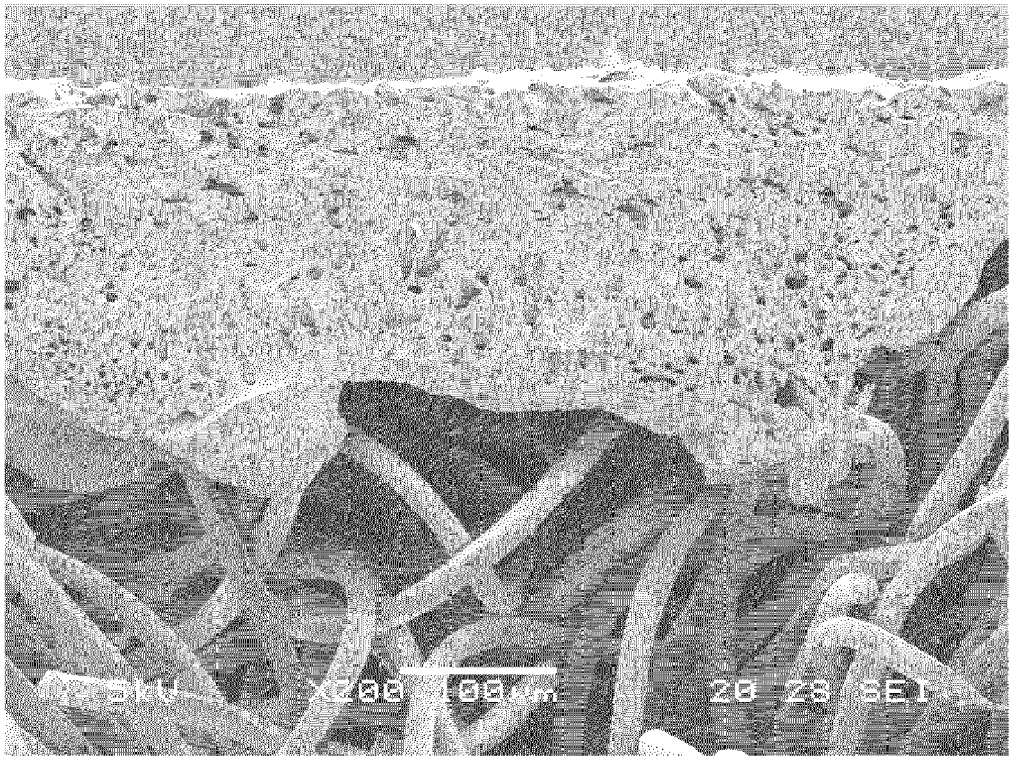
FIG. 1 shows an electron micrograph of a cross-sectional view of synthetic leather obtained in Example 1.
Figure 2:
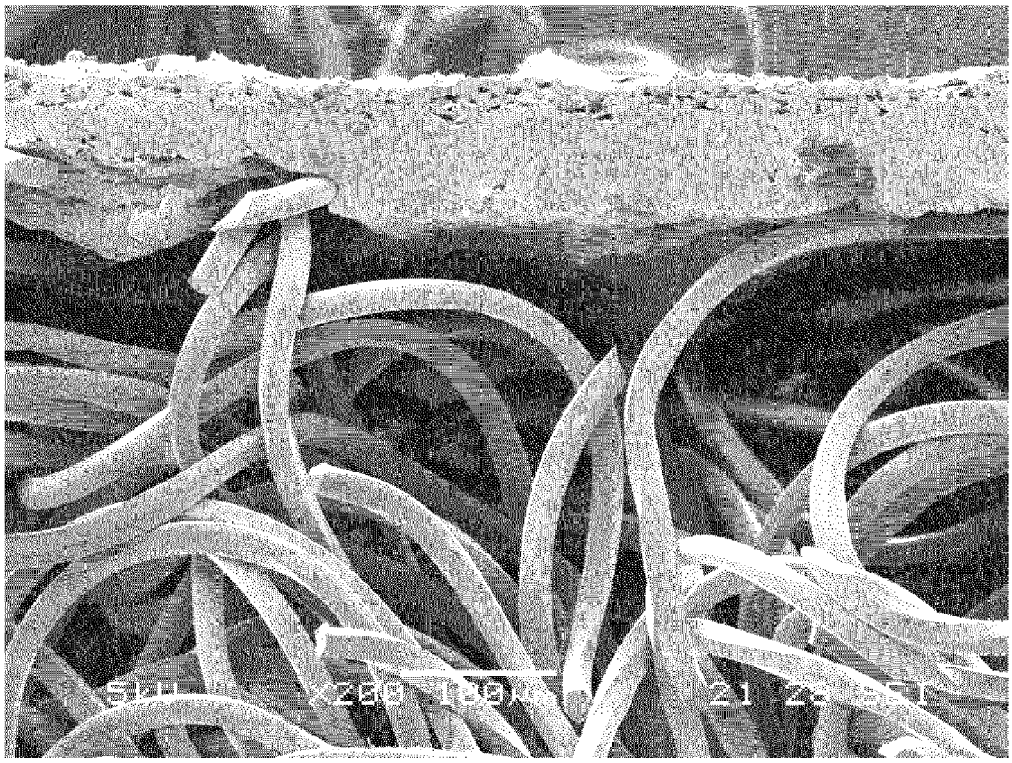
FIG. 2 shows an electron micrograph of a cross-sectional view of synthetic leather obtained in Example 6.

With regard to the method for manufacturing synthetic leather of the present invention, it is required that after obtaining a thickened liquid by mixing a thickening agent (B) with an oxyethylene group content of $2\times10^{-2}$ mol/g or less with an aqueous urethane resin composition containing an aqueous urethane resin (A) having an acid value of 0.01 mgKOH/g or higher in a range of 0.01 to 30 parts by mass relative to 100 parts by mass of the aqueous urethane resin (A), the thickened liquid is coated on a base and coagulated with a coagulating agent (C) containing a metal salt (c-1).

As the aqueous urethane resin (A) to be used in the present invention, use of those having an acid value of 0.01 mgKOH/g or higher is required for conveniently obtaining a porous structure. It is believed that, as the acid value of the aqueous urethane resin (A) is within this range, the synthesized aqueous urethane resin becomes stable and also gets easily coagulated with the coagulating agent (C), and thus a favorable porous structure can be formed. As for the acid value, from the viewpoint of obtaining an even more favorable porous structure, it is preferably in a range of 0.01 to 70 mgKOH/g, more preferably in a range of 1 to 50 mgKOH/g, even more preferably in a range of 3 to 40 mgKOH/g, and particularly preferably in a range of 6 to 30 mgKOH/g. Furthermore, the method for measuring the acid value of the aqueous urethane resin (A) is described in Examples to be described later.

The aqueous urethane resin (A) has the aforementioned acid value, namely, it has an anion-derived structure such as a carboxyl group or a sulfonic acid group. Examples of the aqueous urethane resin (A) which can be used include a reaction product of a polyol (a-1), a compound (a-2) for giving an anionic group, a chain extending agent (a-3), and a polyisocyanate (a-4).

Examples of the polyol (a-1) which can be used include polyether polyol, polycarbonate polyol, polyester polyol, polyacrylpolyol, polybutadiene polyol, and castor oil polyol. These polyols (a-1) can be used either singly or in combination of two or more kinds thereof. Among them, from the viewpoint of forming the porous structure even more stably, it is preferable to use one or more kinds of polyol selected from the group consisting of polyether polyol, polycarbonate polyol, and polyester polyol.

The number average molecular weight of the polyol (a-1) is, from the viewpoint of flexibility and the production stability of the aqueous urethane resin, preferably in a range of 500 to 15,000, more preferably in a range of 600 to 10,000, even more preferably in a range of 700 to 8,000, and particularly preferably in a range of 800 to 5,000. Furthermore, the number average molecular weight of the polyol (a-1) indicates a value measured by gel permeation chromatography (GPC) method.

Examples of the compound (a-2) for giving an anionic group which can be used include a compound having a carboxyl group such as 2,2-dimethylol propionic acid, 2,2-dimethylol butanoic acid, 2,2-dimethylol butyric acid, or 2,2-valeric acid; and a compound having a sulfonyl group such as 3,4-diaminobutane sulfonic acid, 3,6-diamino-2-toluene sulfonic acid, 2,6-diaminobenzene sulfonic acid, or N-(2-aminoethyl)-2-aminoethyl sulfonic acid. These compounds can be used either singly or in combination of two or more kinds thereof. Among them, from the viewpoint of forming an even more favorable porous structure due to favorable reactivity toward the coagulating agent (C), it is preferable to use a compound having a carboxyl group.

In the aqueous urethane resin composition, the anionic group may be neutralized with a basic compound, either partially or entirely. Examples of the basic compound which can be used include organic amines such as ammonia, triethylamine, pyridine, or morpholine; alkanolamines such as monoethanolamine; and metal basic compounds containing sodium, potassium, lithium, calcium, or the like.

The chain extending agent (a-3) has the number average molecular weight in a range of 50 to 490, and examples thereof which can be used include a chain extending agent having an amino group such as ethylenediamine, 1,2-propanediamine, 1,6-hexamethylenediamine, piperazine, 2,5-dimethylpiperazine, isophoronediamine, 1,2-cyclohexanediamine, 1,3-cyclohexanediamine, 1,4-cyclohexanediamine, 4,4'-dicyclohexylmethanediamine, 3,3'-dimethyl-4,4'-dicyclohexylmethanediamine, 1,4-cyclohexanediaimine, or hydrazine; and a chain extending agent having a hydroxyl group such as ethylene glycol, diethylene glycol, triethylene glycol, propylene glycol, dipropylene glycol, 1,3-propanediol, 1,3-butanediol, 1,4-butanediol, hexamethylene glycol, sucrose, methylene glycol, glycerin, sorbitol, bisphenol A, 4,4'-dihydroxydiphenyl, 4,4'-dihydroxydiphenyl ether, or trimethylol propane. These chain extending agents can be used either singly or in combination of two or more kinds thereof. Use amount of the chain extending agent (a-3) is, from the viewpoint of the mechanical strength of a coagulated product, preferably in a range of 0.01 to 8% by mass, and more preferably in a range of 0.01 to 5% by mass relative to the total weight of the raw materials of the aqueous urethane resin (A).

Examples of the polyisocyanate (a-4) which can be used include aromatic polyisocyanates such as phenylene diisocyanate, toluene diisocyanate, diphenylmethane diisocyanate, naphthalene diisocyanate, polymethylene polyphenyl polyisocyanate, or carbodiimidated diphenylmethane polyisocyanate; and aliphatic or alicyclic polyisocyanates such as hexamethylene diisocyanate, lysine diisocyanate, cyclohexane diisocyanate, isophorone diisocyanate, dicyclohexylmethane diisocyanate, xylylene diisocyanate, tetramethyl xylylene diisocyanate, dimer acid diisocyanate, or norbornene diisocyanate. These polyisocyanates can be used either singly or in combination of two or more kinds thereof.

The aqueous urethane resin (A) can be produced by, for example, in the absence of any solvent or in the presence of an organic solvent, mixing the polyol (a-1), the compound (a-2) for giving an anionic group, the chain extending agent (a-3), and the polyisocyanate (a-4) and subjecting the mixture to an urethanization reaction for 3 to 10 hours at a temperature of 50 to 100° C., for example.

Furthermore, the aqueous urethane resin (A) can be also produced by, for example, in the absence of any solvent or in the presence of an organic solvent, mixing the polyol (a-1), the compound (a-2) for giving an anionic group, and the polyisocyanate (a-4) and reacting the mixture for 3 to 10 hours at a temperature of 50 to 100° C., for example, to obtain a urethane prepolymer having an isocyanate group at the molecular terminal, and subsequently reacting the urethane prepolymer with the chain extending agent (a-3).

The [Isocyanate group/(Hydroxyl group+Amino group)] (molar ratio) in the reaction among the polyol (a-1), the compound (a-2) for giving an anionic group, the chain extending agent (a-3), and the polyisocyanate (a-4) is preferably in a range of 0.9 to 1.1, and more preferably in a range of 0.93 to 1.05.

Examples of the organic solvent which can be used for producing the aqueous urethane resin (A) include ketone solvents such as acetone or methyl ethyl ketone; ether solvents such as tetrahydrofuran or dioxane; acetate solvents such as ethyl acetate or butyl acetate; nitrile solvents such as acetonitrile; and amide solvents such as dimethyl formamide or N-methylpyrrolidone. These organic solvents can be used either singly or in combination of two or more kinds thereof.

The average particle diameter of the aqueous urethane resin (A) is, from the viewpoint of preventing forming of a precipitate, preferably in a range of 0.01 to 1 μm, and more preferably in a range of 0.05 to 0.9 μm. Furthermore, the method for measuring the average particle diameter of the aqueous urethane resin (A) is described in Examples to be described later.

The weight average molecular weight of the aqueous urethane resin (A) is, from the viewpoint of flexibility, physical properties such as strength, and processability of a processed product, preferably in a range of 10,000 to 1,000,000, and more preferably in a range of 30,000 to 500,000. Furthermore, the weight average molecular weight of the aqueous urethane resin (A) indicates a value that is measured in the same manner as the number average molecular weight of the polyol (a1).

The content of the aqueous urethane resin (A) in the aqueous urethane resin composition is, from the viewpoint of obtaining favorable viscosity and coating workability, preferably in a range of 10 to 60% by mass, and more preferably in a range of 20 to 50% by mass in the aqueous urethane resin composition.

It is preferable for the aqueous urethane resin composition to contain, other than the aqueous urethane resin (A), an aqueous medium (Z) from the viewpoint of coating property or storage stability.

Examples of the aqueous medium (Z) which can be used include water, organic solvents miscible with water, and mixtures thereof. Examples of the organic solvents miscible with water which can be used include alcohol solvents such as methanol, ethanol, n-propanol, or isopropanol; ketone solvents such as acetone or methyl ethyl ketone; polyalkylene glycol solvents such as ethylene glycol, diethylene glycol, or propylene glycol; polyalkylene polyol alkyl ether solvents; and lactam solvents such as N-methyl-2-pyrrolidone. Among them, it is preferable to use water from the viewpoint of environmental property.

As the method for producing the aqueous urethane resin composition, a method in which the production is made by, in the absence of any solvent or in the presence of an organic solvent, producing the aqueous urethane resin (A), subsequently, if necessary, after neutralizing the anionic group in the aqueous urethane resin (A), supplying the aqueous medium (Z), and dispersing the aqueous urethane resin (A) in the aqueous medium (Z) can be mentioned, for example.

For mixing the aqueous urethane resin (A) with the aqueous medium (Z), it is also possible to use a machine like homogenizer, if necessary.

Furthermore, for producing the aqueous urethane resin composition, it is also possible to use an emulsifying agent from the viewpoint of enhancing the dispersion stability of the aqueous urethane resin (A) in the aqueous medium (Z).

Examples of the emulsifying agent which can be used include nonionic emulsifying agents such as polyoxyethylene nonylphenyl ether, polyoxyethylene lauryl ether, polyoxyethylene styrylphenyl ether, polyoxyethylene sorbitol tetraoleate, or polyoxyethylene•polyoxypropylene copolymers; anionic emulsifying agents such as fatty acid salts including sodium oleate or the like, alkyl sulfates, alkyl benzene sulfonates, alkyl sulfosuccinates, naphthalene sulfonates, polyoxyethylene alkyl sulfates, sodium alkane sulfonates, or sodium alkyl diphenyl ether sulfonates; and cationic emulsifying agents such as alkyl amine salts, alkyl trimethyl ammonium salts, or alkyl dimethyl benzyl ammonium salts. These emulsifying agents can be used either singly or in combination of two or more kinds thereof.

The aqueous polyurethane composition may contain, other than the aqueous urethane resin (A) and the aqueous medium (Z), other additives.

Examples of the additives which can be used include an anti-foaming agent, a urethanization catalyst, a silane-coupling agent, a filler, a wax, a heat stabilizer, a light resistance stabilizer, a pigment, a dye, an anti-static agent, an oil-repellent, a flame retardant, and an anti-blocking agent. These additives can be used either singly or in combination of two or more kinds thereof.

According to the present invention, it is required to thicken the aqueous urethane resin composition by using the thickening agent (B) with the oxyethylene group content of $2\times10^{-2}$ mol/g or less. It means that, as the thickening agent (B) is relatively unlikely to get dissolved in the aqueous medium (Z), it is believed that the thickening agent remained in the aqueous urethane resin (A) at the time of obtaining a coagulated product yields a hollow space upon drying so that a porous structure can be conveniently formed. On the other hand, in a case in which a thickening agent with the oxyethylene group content of more than $2\times10^{-2}$ mol/g is used, it is believed that the aforementioned hollow space is not formed due to high dissolution in water, and thus the porous structure is not formed. The oxyethylene group content in the thickening agent (B) is, from the viewpoint of forming a more favorable porous structure, preferably $1.8\times10^{-2}$ mol/g or less, and more preferably $1.7\times10^{-2}$ mol/g or less. Furthermore, for calculating the oxyethylene group content in the thickening agent (B), the calculation should be made by using the total mole number of the oxyethylene group [$CH_2CH_2O$] relative to the total mass of every compound contained in the thickening agent (B) excluding solvent. For example, in a case in which a urethane thickening agent containing a urethane compound, an additive like an emulsifying agent, and water is used as the thickening agent (B), the calculation should be made by using the total mole number of the oxyethylene group in the urethane compound and additives relative to the total mass of those excluding water, namely, the urethane compound and additives.

Furthermore, in the present invention, it is required to add the thickening agent (B) in a range of 0.01 to 30 parts by mass relative to 100 parts by mass of the aqueous urethane resin (A) (=solid content) in the aqueous urethane resin composition. If the addition amount of the thickening agent (B) is less than 0.01 part by mass, there is a problem that the desired thickening effect is not obtained and poor coating property is yielded, or a problem that the porous structure cannot be formed. On the other hand, if the addition amount is more than 30 parts by mass, not only the porous structure cannot be formed but also the structure is brittle, and thus an industrially usable coating film cannot be obtained. The addition amount of the thickening agent (B) is, from the viewpoint of obtaining an even more preferable porous structure, preferably in a range of 0.1 to 20 parts by mass, and more preferably in a range of 0.15 to 10 parts by mass relative to 100 parts by mass of the aqueous urethane resin (A). Furthermore, the addition amount of the thickening agent (B) should be calculated based on solid content. For example, in a case in which carboxymethyl cellulose is diluted with water and used as the thickening agent (B), the addition amount of the thickening agent (B) is to be calculated based on the use amount of the carboxymethyl cellulose itself. Furthermore, for example, in a case in which a urethane thickening agent containing a urethane compound, an additive such as an emulsifying agent, and water is used as the thickening agent (B), the addition amount of the thickening agent (B) is to be calculated based on the total mass of those excluding water, namely, the urethane compound and additives.

Specific examples of the thickening agent (B) which can be used include a cellulose thickening agent; an acryl thickening agent; a urethane thickening agent; a protein thickening agent such as casein, sodium caseinate, or ammonium caseinate; a polyvinyl thickening agent such as polyvinyl alcohol, polyvinyl pyrrolidone, or a polyvinyl benzyl ether copolymer; a polyether thickening agent such as pluronic polyether, polyether dialkylester, polyether dialkyl ether, or polyether epoxy modified product; a maleic anhydride thickening agent such as a vinyl methyl ether-maleic anhydride copolymer; and a polyamide thickening agent such as polyamideamine salt. These thickening agents can be used either singly or in combination of two or more kinds thereof. Furthermore, for adding the thickening agent (B) to an aqueous urethane resin composition, it is also possible that the thickening agent (B) is used after dilution with an aqueous medium or the like. As the thickening agent (B), from the viewpoint that the mixture liquid containing the aqueous urethane resin (A) and the thickening agent (C) is in a dispersion state that is suitable for forming a porous structure and can form an even more favorable porous structure, it is preferable to use, among those described in the above, one or more kinds selected from the group consisting of a cellulose thickening agent, an acryl thickening agent, and a urethane thickening agent.

Examples of the cellulose thickening agent which can be used include carboxymethyl cellulose, methyl cellulose, and hydroxyethyl cellulose. These thickening agents can be used either singly or in combination of two or more kinds thereof. Among them, from the viewpoint that the mixture liquid containing the aqueous urethane resin (A) and the thickening agent (C) is in a dispersion state that is suitable for forming a porous structure and can form an even more favorable porous structure, it is preferable to use carboxymethyl cellulose and/or methyl cellulose. In particular, from the viewpoint of forming vertically long cells and obtaining synthetic leather having even more excellent touch feeling, carboxymethyl cellulose is more preferable.

As the acryl thickening agent, for example, polyacrylic acid salt, a polymerization product between (meth) acrylic acid and (meth)acrylic acid ester, or the like can be used. These thickening agents can be used either singly or in combination of two or more kinds thereof.

The polyacrylic acid salt is a polymerization product of one or more kinds of compound selected from the group consisting of acrylic acid, methacrylic acid, acrylic acid salt, and methacrylic acid salt.

Examples of the salt which can be used include alkali metal salts such as sodium salt, potassium salt, or lithium salt; alkali earth metal salts such as magnesium salt or calcium salt; ammonium salt; alkanolamine salts such as monoethanolamine salt, diethanolamine salt, or triethanolamine salt; and alkylamine salts such as methylamine salt, ethylamine salt, propylamine salt, or butylamine salt.

Examples of the (meth)acrylic acid which can be used include acrylic acid and methacrylic acid. These compounds can be used either singly or in combination of two or more kinds thereof.

Examples of the (meth)acrylic acid ester include (meth) acrylic acid ester having 1 to 4 carbon atoms such as methyl(meth)acrylate, ethyl(meth)acrylate, n-propyl(meth) acrylate, isopropyl(meth)acrylate, n-butyl(meth)acrylate, isobutyl(meth)acrylate, or ter-butyl(meth)acrylate; and (meth)acrylic acid ester having an oxyethylene group such as (meth)acrylate added with 3 to 60 moles of n-docosanol ethylene oxide, (meth)acrylate added with 3 to 60 moles of n-octadecanolethylene oxide, or (meth)acrylate added with 3 to 60 moles of n-hexadecanolethylene oxide. These compounds can be used either singly or in combination of two or more kinds thereof. Furthermore, as described herein, the (meth)acrylic acid ester means acrylic acid ester and/or acrylic acid ester and the (meth)acrylate means acrylate and/or methacrylate.

In a case in which a polymerization product between (meth)acrylic acid and (meth)acrylic acid ester is used, from the viewpoint of forming even more stably vertically long cells, the polymerization product is obtained by using (meth) acrylic acid preferably at 20% by mass or more, more preferably at 40% by mass or more, and even more preferably in a range of 50 to 99% by mass.

As the acryl thickening agent, from the viewpoint of forming a porous structure even more stably due to the reason that the thickening effect is suitable for processing suitability, it is preferable to use a polymerization product between polyacrylic acid salt and/or (meth)acrylic acid and (meth)acrylic acid ester among those described in the above, and in particular, from the viewpoint of forming vertically long cells and obtaining synthetic leather having even more excellent touch feeling, polyacrylic acid salt is more preferable.

As the urethane thickening agent, for example, an agent containing a urethane compound, which is a reaction product among oxyalkylene polyol, polyisocyanate, and a glycol compound having a carboxy group can be used.

As the oxyalkylene polyol, for example, a polymerization product between polyhydric alcohol and alkylene oxide can be used.

As the polyhydric alcohol, for example, it is possible to use a glycol such as ethylene glycol, 1,2-propylene glycol, 1,3-propylene glycol, 1,3-butylene glycol, 1,4-butylene glycol, 1,5-pentanediol, 2,2-dimethyl-1,3-propanediol, 1,6-hexanediol, 3-methyl-1,5-pentanediol, 1,8-octanediol, diethylene glycol, triethylene glycol, dipropylene glycol, tripropylene glycol, cyclohexane-1,4-diol, or cyclohexane-1,4-dimethanol; a polyester polyol; or the like. These compounds can be used either singly or in combination of two or more kinds thereof.

As the alkylene oxide, for example, it is possible to use ethylene oxide, propylene oxide, butylene oxide, styrene oxide, or the like. These compounds can be used either singly or in combination of two or more kinds thereof.

As the oxyalkylene polyol, from the viewpoint of the production stability and thickening property, it is preferable to use polyethylene glycol among those described above.

The number average molecular weight of the polyoxyalkylene polyol is preferably in a range of 2,000 to 12,000, and more preferably in a range of 2,500 to 10,000 from the viewpoint of enhancing the processing suitability at the time of preparing the mixture liquid. Furthermore, the number average molecular weight of the polyoxyalkylene polyol indicates a value that is measured in the same manner as the number average molecular weight of the polyol (al).

If necessary, the polyoxyalkylene polyol may be used in combination with other polyols. Examples of other polyols which can be used include polycarbonate polyol, polyester polyol, polyacryl polyol, and polybutadiene polyol. These polyols can be used either singly or in combination of two or more kinds thereof.

Examples of the polyisocyanate which can be used include aromatic polyisocyanates such as phenylene diisocyanate, toluene diisocyanate, diphenylmethane diisocyanate, naphthalene diisocyanate, polymethylene polyphenyl polyisocyanate, or carbodiimidated diphenylmethane polyisocyanate; and aliphatic or alicyclic polyisocyanates such as hexamethylene diisocyanate, lysine diisocyanate, cyclohexane diisocyanate, isophorone diisocyanate, dicyclohexylmethane diisocyanate, xylylene diisocyanate, tetramethylxylylene diisocyanate, dimer acid diisocyanate, or norbornene diisocyanate. These polyisocyanates can be used either singly or in combination of two or more kinds thereof.

As the glycol compound having a carboxy group, for example, 2,2-dimethylol propionic acid, 2,2-dimethylol butanoic acid, 2,2-dimethylol butyric acid, 2,2-valeric acid, or the like can be used. These compounds can be used either singly or in combination of two or more kinds thereof.

Furthermore, by using a compound which additionally has a hydroxyl group or an amino group and a hydrophobic group for the urethane compound, the terminal group of the urethane compound can be also prepared as a hydrophobic group.

Examples of the compound which has a hydroxyl group or an amino group and a hydrophobic group include branched aliphatic alcohols such as 2-butyl-1-octanol, 2-butyl-1-decanol, 2-hexyl-1-octanol, 2-hexyl-1-decanol, isononyl alcohol, isodecyl alcohol, or isoundecyl alcohol; linear aliphatic alcohols such as 1-hexadecanol, 1-tetradecanol, 1-dodecanol, 1-undecanol, 1-decanol, 1-nonanol, 1-octanol, or 1-hexanol; alkylaryl alcohols such as nonylphenol or tristyrylphenol; aliphatic amines such as 1-decylamine, 1-octylamine, 1-hexylamine, dioctylamine, or dihexylamine; polyalkylene glycol monoalkyl ethers such as polyethylene glycol monoalkyl ether (the number of carbon atoms of the alkyl group is 8 to 24) or polypropylene glycol monoalkyl ether (the number of carbon atoms of the alkyl group is 8 to 24); and polyalkylene glycol monoalkylphenyl ethers such as polyethylene glycol monoalkylphenyl ether (the number of carbon atoms of the alkyl group is 8 to 24) or polypropylene glycol monoalkylphenyl ether (the number of carbon atoms of the alkyl group is 8 to 24).

The weight average molecular weight of the urethane compound is, from the viewpoint of forming an even more favorable porous structure, preferably in a range of 2,000 to 100,000, more preferably in a range of 10,000 to 90,000, and even more preferably in a range of 20,000 to 80,000. Furthermore, the weight average molecular weight of the urethane compound indicates a value that is measured in the same manner as the polyol (a1).

The urethane thickening agent may also contain additives other than the aforementioned urethane compound. Examples of the additives which can be used include an aqueous medium, an emulsifying agent, an anti-foaming agent, and a dispersion agent. These additives can be used either singly or in combination of two or more kinds thereof. As the emulsifying agent, for example, the same emulsifying agent as those usable for producing the aqueous urethane resin composition can be used.

As a method of controlling the content of an oxyethylene group in a case in which a urethane thickening agent is used as the thickening agent (B), a method of using polyoxyalkylene polyol with a low content of an oxyethylene group as the polyoxyalkylene polyol which is used as raw material, a method of reducing the use amount of polyethylene glycol, a method of using an emulsifying agent with a low content of an oxyethylene group, a method of reducing the use amount of an emulsifying agent having an oxyethylene group, or the like can be mentioned.

When the aqueous urethane resin composition is thickened with the thickening agent (B), from the viewpoint of obtaining an even more favorable porous structure, the aqueous urethane resin composition containing the thickening agent (B) is preferably thickened to viscosity of 400 mPa·s or higher, more preferably thickened to a range of 450 to 20,000 mPa·s, and even more preferably thickened to a range of 500 to 15,000 mPa·s. Furthermore, the method for measuring the viscosity of the aqueous urethane resin composition (containing the thickening agent) indicates a value that is measured at 25° C. by B-type viscometer (M3 rotor, 30 revolutions). Furthermore, after the thickening followed by defoaming using a defoaming device or the like, it is preferable to carry out salt coagulation which will be described later.

As the method for thickening the aqueous urethane resin composition with the thickening agent (B), it is favorable that the thickening agent (B) and the aqueous urethane resin composition are brought into contact with each other, and examples thereof include a method in which the (B) and the aqueous urethane resin composition are admixed with each other. For the mixing, it is possible to use a stirring bar, a mechanical mixer, or the like. Furthermore, after the thickening followed by defoaming by using a defoaming device or the like, it is preferable to carry out salt coagulation which will be described later.

Examples of the method of coating the liquid after thickening on a base include a knife coater method, a spray method, a curtain coater method, a flow coater method, a roll coater method, and a brush coating method. The thickness for coating in this case is suitably determined depending on a desired use and is, for example, in a range of 10 to 2,000 μm.

Examples of the base include a fibrous base such as non-woven fabric, woven fabric, or knitted product, thermoplastic urethane (TPU), and a release paper having a top surface layer for synthetic leather formed thereon.

Mention can be made of, for example, a method for obtaining an aqueous urethane resin layer with a porous structure on abase in which, after coating the thickened liquid on a base, immersion in the coagulation bath (C) is carried out followed by drying.

As a method of immersing a coated product coated with the addition mixture in the coagulation bath (C), a method in which the coated product is directly immersed in a tank storing the coagulation bath (C) and the salt coagulation is allowed to occur can be mentioned. The time for immersion•coagulation for this case is 1 second to 30 minutes, for example.

Examples of the metal salt (c-1) which can be used include calcium nitrate, calcium chloride, zinc nitrate, zinc chloride, magnesium acetate, aluminum sulfate, and sodium chloride. These metal salts can be used either singly or in combination of two or more kinds thereof. Among them, from the viewpoint of further enhancing the coagulation property according to the effect of pressing an electric double layer, it is preferable to use calcium nitrate.

The coagulation bath (C) may also contain a solvent other than the metal salt (c-1).

Examples of the solvent which can be used include the same aqueous medium as the aqueous medium (Z); and alcohol solvents such as methanol, ethanol, 1-propanol, 2-propanol, 1-butanol, 2-butanol, 2-methyl-2-propanol, 1-pentanol, 2-pentanol, 2-methyl-2-butanol, 1-hexanol, 2-hexanol, cyclohexanol, 2-methyl-2-pentanol, or 3-methyl-3-pentanol.

The content of the metal salt (c-1) in the coagulation bath (C) is, from the viewpoint of carrying out favorable salt coagulation, preferably in a range of 1 to 40% by mass, and more preferably in a range of 2 to 30% by mass.

After the coagulation process, if necessary, unnecessary coagulating agents may be removed by washing according to immersion of the coagulated product in water or immersion in running water for 10 minutes to 8 hours, for example. Furthermore, it is also possible to carry out hot-air drying for 1 minute to 3 hours at 60 to 120° C. thereafter, for example.

According to the method described above, synthetic leather which has a base and a urethane resin layer with a porous structure can be obtained. As for the synthetic leather, when a fibrous base or thermoplastic urethane is used as the base, an additional top surface layer may be also formed by a known method on the top of the urethane resin layer with a porous structure.

The top surface layer can be formed with known materials by a known method, and, for example, a solvent-based urethane resin, a water-borne urethane resin, a silicone resin, a polypropylene resin, a polyester resin, or the like can be used. When flexible touch feeling, heat resistance, and anti-hydrolysis property are considered to be important, it is preferable to use a polycarbonate-based urethane resin. Furthermore, for reducing DMF to deal with the environmental issues, it is more preferable to use a water-borne polycarbonate-based urethane resin.

If necessary, a surface treatment layer may be formed on the top of the top surface layer for the purpose of enhancing abrasion resistance or the like. The surface treatment layer may be formed with known materials by a known method.

Furthermore, when a top surface layer is used on the top of a release paper as the base, it is also possible that a fibrous base or thermoplastic urethane is additionally applied on the urethane resin layer with a porous structure.

As described in the above, according to the manufacturing method of the present invention, a urethane resin layer with a porous structure can be conveniently formed with an aqueous urethane resin composition without undergoing a process of heating or foaming, and thus synthetic leather with excellent touch feeling can be obtained.

EXAMPLES

Hereinbelow, the present invention will be described in greater detail by using Examples.

[Preparation Example 1] Preparation of Aqueous Urethane Resin Composition (X-1)

In a nitrogen-flushed reaction vessel equipped with a thermometer, nitrogen gas, an inlet, and a stirrer, a reaction was allowed to occur at 70° C. in the presence of 500 parts by mass of polytetramethylene ether glycol (number average molecular weight; 2,000), 25 parts by mass of 2,2'-dimethylol propionic acid (hereinbelow, abbreviated as "DMPA"), 128 parts by mass of dicyclohexylmethane diisocyanate (hereinbelow, abbreviated as "$H_{12}$MDI"), and 620 parts by mass of methyl ethyl ketone until the reaction product reaches the required NCO% so that a methyl ethyl ketone solution of a urethane prepolymer having an isocyanate group at the terminal thereof was obtained.

Subsequently, to an organic solvent solution of the urethane prepolymer, 23 parts by mass of triethylamine was added as a neutralizing agent followed by stirring, and, by further adding 830 parts by mass of water followed by stirring, an emulsion having the urethane prepolymer dispersed in water was obtained.

The obtained emulsion was admixed with 3.2 parts by mass of an aqueous solution of a chain extending agent in which hydrazine is contained at 2.6 parts by mass and the chain extension reaction was allowed to occur to give an aqueous dispersion of the urethane resin (A-1). Subsequently, solvents were removed from the aqueous dispersion so that an aqueous urethane resin composition (X-1) with the non-volatile content of 30% by mass was obtained.

[Preparation Example 2] Preparation of Aqueous Urethane Resin Composition (X-2)

In a nitrogen-flushed reaction vessel equipped with a thermometer, nitrogen gas, an inlet, and a stirrer, a reaction was allowed to occur at 70° C. in the presence of 250 parts by mass of polycarbonate diol ("ETERNACOLL UH-200" manufactured by Ube Industries, Ltd., number average molecular weight; 2,000), 18 parts by mass of DMPA, 90 parts by mass of $H_{12}$MDI, and 236 parts by mass of methyl ethyl ketone until the reaction product reaches the required NCO % so that a methyl ethyl ketone solution of a urethane prepolymer having an isocyanate group at the terminal thereof was obtained.

Subsequently, to an organic solvent solution of the urethane prepolymer, 16 parts by mass of triethylamine was added as a neutralizing agent followed by stirring, and, by further adding 797 parts by mass of water followed by stirring, an emulsion having the urethane prepolymer dispersed in water was obtained.

The obtained emulsion was admixed with 6.3 parts by mass of an aqueous solution of a chain extending agent in which hydrazine is contained at 5.0 parts by mass and the chain extension reaction was allowed to occur to give an aqueous dispersion of the urethane resin (A-2). Subsequently, solvents were removed from the aqueous dispersion so that an aqueous urethane resin composition (X-2) with the non-volatile content of 35% by mass was obtained.

[Preparation Example 3] Preparation of Aqueous Polyurethane Composition (X-3)

To a nitrogen-flushed reaction vessel equipped with a thermometer, nitrogen gas, an inlet, and a stirrer, 155 parts by mass of 1,6-hexane diol (hereinbelow, abbreviated as "HG"), 137 parts by mass of neopentyl glycol, and 424 parts by mass of adipic acid were added, and the mixture was melt at 120° C. Subsequently, under stirring, the temperature was raised to 220° C. over 3 hours to 4 hours and then maintained for 5 hours. After cooling to 150° C., 88 parts by mass of DMPA was added and, after keeping the resultant for 5 hours to 10 hours under stirring at 150° C., by adding 300 parts by mass of methyl ethyl ketone thereto, a methyl ethyl ketone solution of polyester polyol with a carboxyl group (X-3-a) having the non-volatile content of 70% by mass was prepared.

In a nitrogen-flushed reaction vessel equipped with a thermometer, nitrogen gas, an inlet, and a stirrer, a reaction was allowed to occur at 70° C. in the presence of 198 parts by mass of the methyl ethyl ketone solution of polyester polyol (X-3-a) with a carboxyl group, 160 parts by mass of polyester polyol ("CRISVON CMA-654" manufactured by DIC Corporation, number average molecular weight; 1,500), 19 parts by mass of HG, 75 parts by mass of tolylene diisocyanate, and 152 parts by mass of methyl ethyl ketone until the reaction product reaches the required NCO% so that a methyl ethyl ketone solution of a urethane prepolymer having an isocyanate group at the terminal thereof was obtained.

Subsequently, to an organic solvent solution of the urethane prepolymer, 17.2 parts by mass of triethylamine was added as a neutralizing agent followed by stirring, and, by further adding 653 parts by mass of water and 7.7 parts by mass of piperazine followed by mixing to have a chain extension reaction, an aqueous dispersion of the urethane resin (A-3) was obtained. Subsequently, solvents were removed from the aqueous dispersion so that an aqueous urethane resin composition (X-3) with the non-volatile content of 40% by mass was obtained.

[Preparation Example 4] Preparation of Aqueous Polyurethane Composition (X'-1)

In a nitrogen-flushed reaction vessel equipped with a thermometer, nitrogen gas, an inlet, and a stirrer, a reaction was allowed to occur at 70° C. in the presence of 1,000 parts by mass of polytetramethylene glycol (manufactured by Mitsubishi Chemical Corporation, number average molecular weight: 2,000), 50 parts by mass of "UNILUBE 75DE-60" manufactured by NOF CORPORATION (polyoxyethyleneoxypropylene glycol, Polyoxyethylene structure/Polyoxypropylene structure (mass ratio)=75/25, number average molecular weight: about 3,000), 50 parts by mass of "UNILUBE 75MB-900" manufactured by NOF CORPORATION (polyoxyethyleneoxypropylene glycol monobutyl ether, Polyoxyethylene structure/Polyoxypropylene structure (mass ratio)=75/25, number average molecular weight: about 3,400), 183 parts by mass of $H_{12}$MDI, and 1,283 parts by mass of methyl ethyl ketone until the reaction product reaches the required NCO % so that a methyl ethyl ketone solution of a urethane prepolymer having an isocyanate group at the terminal thereof was obtained.

Subsequently, to an organic solvent solution of the urethane prepolymer, 2,566 parts by mass of water was added followed by stirring to obtain an aqueous dispersion of the aqueous urethane resin. The obtained emulsion and 135 parts by mass of an aqueous solution of a chain extending agent in which piperazine is contained at 13.5 parts by mass were admixed with each other to have a chain extension reaction, and an aqueous dispersion of the urethane resin (A'-1) was obtained. Subsequently, solvents were removed from the aqueous dispersion so that an aqueous urethane resin composition (X'-1) with the non-volatile content of 40% by mass was obtained.

Example 1

To 100 parts by mass of the aqueous urethane resin "HYDRAN WLS-250" manufactured by DIC Corporation, 10 parts by mass of a pigment "DILAC BLACK HS-9533" manufactured by DIC Corporation was added and, by using a comma coater, coating on the top of a release paper was carried out such that the coating amount is 100 g/m$^2$ in terms of wet amount. After that, drying was carried out at 70° C. for 2 minutes and at 120° C. for 2 minutes to produce a top surface layer with the thickness of 30 μm.

Separate from the above, 100 parts by mass of the aqueous urethane resin composition (X-1) were admixed with 6.3 parts by mass of carboxymethyl cellulose (manufactured by DKS Co. Ltd., "CELLOGEN WS-C", hereinbelow, abbreviated as "CMC"), which has been diluted to 10% by mass with water, stirred using a mechanical mixer at 800 rpm for 10 minutes, and then deaerated using a centrifugal deaerator to prepare a mixture liquid. The mixture liquid (aqueous urethane resin composition containing a thickening agent) had viscosity of 2,600 mPa·s.

The mixture liquid was coated using knife coating on a non-woven fabric made of polyester fiber. Subsequently, the resultant was immersed in a 5% by mass aqueous solution of calcium nitrate for 3 minutes to coagulate the mixture liquid. Then, the resultant coagulated product was immersed in running water for 5 hours to wash and remove the excess coagulating agent. Then, the coagulated product was dried at 70° C. for 20 minutes and at 120° C. for 20 minutes to give a laminate of a fibrous base and a urethane resin layer with a porous structure. Then, by attaching the laminate onto the above top surface layer, synthetic leather was obtained.

Examples 2 to 7 and Comparative Examples 1 to 4

Synthetic leather was manufactured in the same manner as in Example 1 except that the type of the aqueous urethane resin composition and the type and amount of the thickening agent (B) that are used were changed as shown in Tables 1 to 3.

Method for Measurement of Number Average Molecular Weight

The number average molecular weight of the polyols used in the preparation examples indicates a value measured by gel permeation column chromatography (GPC) under the following conditions.

Measurement device: High performance GPC apparatus ("HLC-8220GPC" manufactured by Tosoh Corporation)

Column: The following columns manufactured by Tosoh Corporation were connected in series and used.

"TSKgel G5000" (7.8 mm I.D.×30 cm)×1
"TSKgel G4000" (7.8 mm I.D.×30 cm)×1
"TSKgel G3000" (7.8 mm I.D.×30 cm)×1
"TSKgel G2000" (7.8 mm I.D.×30 cm)×1

Detector: RI (differential refractometer)

Column temperature: 40° C.

Eluent: Tetrahydrofuran (THF)

Flow rate: 1.0 mL/minute

Injection amount: 100 μL (tetrahydrofuran solution with the sample concentration of 0.4% by mass)

Standard samples: The following polystyrene standards were used to establish a calibration curve.

(Polystyrene Standards)

"TSKgel standard polystyrene A-500" manufactured by Tosoh Corporation
"TSKgel standard polystyrene A-1000" manufactured by Tosoh Corporation
"TSKgel standard polystyrene A-2500" manufactured by Tosoh Corporation
"TSKgel standard polystyrene A-5000" manufactured by Tosoh Corporation
"TSKgel standard polystyrene F-1" manufactured by Tosoh Corporation
"TSKgel standard polystyrene F-2" manufactured by Tosoh Corporation
"TSKgel standard polystyrene F-4" manufactured by Tosoh Corporation
"TSKgel standard polystyrene F-10" manufactured by Tosoh Corporation
"TSKgel standard polystyrene F-20" manufactured by Tosoh Corporation
"TSKgel standard polystyrene F-40" manufactured by Tosoh Corporation
"TSKgel standard polystyrene F-80" manufactured by Tosoh Corporation
"TSKgel standard polystyrene F-128" manufactured by Tosoh Corporation
"TSKgel standard polystyrene F-288" manufactured by Tosoh Corporation
"TSKgel standard polystyrene F-550" manufactured by Tosoh Corporation

Method for Measurement of Average Particle Diameter of aqueous urethane resin (A)

With respect to the aqueous urethane resin compositions obtained in the Preparation Examples, by using a laser diffraction/scattering-type particle size distribution measurement apparatus ("LA-910", manufactured by HORIBA, Ltd.) and using water as a dispersing liquid, an average particle diameter was measured at a relative refractive index of 1.10 in which the particle diameter was measured on an area basis.

Method for Measurement of Acid Value of Aqueous Urethane Resin (A)

The aqueous urethane resin compositions obtained in the Preparation Examples were dried, and 0.05 to 0.5 g of the dried and solidified resin particles was weighed and placed in a 300 mL conical flask. Then, about 80 mL of a mixed solvent of tetrahydrofuran and ion-exchange water in a mass ratio [Tetrahydrofuran/Ion-exchange water] of 80/20 was added to the resin particles to obtain a mixture thereof.

Subsequently, a phenolphthalein indicator was mixed into the obtained mixture, and then the mixture was subjected to titration using a 0.1 mol/L aqueous solution of potassium hydroxide which had been previously subjected to standardization. From the amount of the aqueous solution of potassium hydroxide used for the titration, an acid value (mgKOH/g) of the aqueous urethane resin (A) was determined according to the following formula (2) for calculation.

$$\text{Formula for calculation: } A=(B\times f\times 5.611)/S \quad (2)$$

In the above formula, A is the acid value (mgKOH/g) of the resin in terms of solids, B is the amount (mL) of the 0.1 mol/L aqueous solution of potassium hydroxide used for the titration, f is the factor of the 0.1 mol/L aqueous solution of potassium hydroxide, S is the mass (g) of the resin particles, and 5.611 is the formula weight (56.11/10) of potassium hydroxide.

Method for Evaluation of Forming State of Porous Structure in Urethane Resin Layer With regard to the synthetic leather obtained from Examples and Comparative Examples, the urethane resin layer before forming the top surface layer was observed using a scanning electron microscope "SU3500" manufactured by Hitachi High-Tech Corporation (magnification: 2,000), and then evaluated as follows.

"A"; In the electron micrograph of a cross-sectional view of the urethane resin layer, vertically long cells are found in large numbers.

"B"; In the electron micrograph of a cross-sectional view of the urethane resin layer, holes are found in large numbers.

"C"; Other than those described in the above.

Method for Measurement of Touch Feeling of Synthetic Leather

The evaluation was made as follows based on the touch feeling resulting from touching the synthetic leather obtained from Examples and Comparative Examples by hand. Furthermore, when the evaluation could not be made due to the absence of resin coagulation, it was evaluated "-".

"A"; Both the tension and compact feeling are excellent.

"B"; Both the tension and compact feeling are felt.

"C"; Both the tension and compact feeling are slightly poor.

"D"; Both the tension and compact feeling are not felt at all.

TABLE 1

| | Example 1 | Example 2 | Example 3 | Example 4 |
|---|---|---|---|---|
| Aqueous urethane resin composition | (X-1) | (X-2) | (X-3) | (X-1) |
| Aqueous urethane resin (A) | (A-1) | (A-2) | (A-3) | (A-1) |
| Acid value (mgKOH/g) | 16 | 21 | 18 | 16 |
| Thickening agent (B) | CMC | CMC | CMC | CMC |
| Content of oxyethylene group (mol/g) | 0 | 0 | 0 | 0 |

TABLE 1-continued

| | Example 1 | Example 2 | Example 3 | Example 4 |
|---|---|---|---|---|
| Addition amount of thickening agent (B) (parts by mass) (relative to 100 parts by mass of aqueous urethane resin (A)) | 1.1 | 0.5 | 0.64 | 8 |
| Viscosity of aqueous urethane resin composition after thickening (mPa · s) | 2,600 | 2,800 | 2,175 | 13,000 |
| Coagulation bath (C) | | | | |
| Metal salt (c-1) | Calcium nitrate | Calcium nitrate | Calcium nitrate | Calcium nitrate |
| Forming state of porous structure in urethane resin layer | A | A | A | A |
| Touch feeling of synthetic leather | A | A | A | A |

TABLE 2

| | Example 5 | Example 6 | Example 7 | Comparative Example 1 |
|---|---|---|---|---|
| Aqueous urethane resin composition | (X-1) | (X-2) | (X-1) | (X-1) |
| Aqueous urethane resin (A) | (A-1) | (A-2) | (A-1) | (A-1) |
| Acid value (mgKOH/g) | 16 | 21 | 16 | 16 |
| Thickening agent (B) | ALA | MC | L75N | T10 |
| Content of oxyethylene group (mol/g) | 0 | 0 | $1.6\times10^{-2}$ | $2.1\times10^{-2}$ |
| Addition amount of thickening agent (B) (parts by mass) (relative to 100 parts by mass of aqueous urethane resin (A)) | 0.54 | 1.7 | 2 | 1 |
| Viscosity of aqueous urethane resin composition after thickening (mPa · s) | 2,000 | 576 | 6,000 | 3,000 |
| Coagulation bath (C) | | | | |
| Metal salt (c-1) | Calcium nitrate | Calcium nitrate | Calcium nitrate | Calcium nitrate |
| Method for evaluation of forming state of porous structure in urethane resin layer | A | B | B | C |
| Touch feeling of synthetic leather | A | B | B | D |

TABLE 3

| | Comparative Example 2 | Comparative Example 3 | Comparative Example 4 |
|---|---|---|---|
| Aqueous urethane resin composition | (X'-1) | (X-1) | (X-1) |
| Aqueous urethane resin (A) | (A'-1) | (A-1) | (A-1) |
| Acid value (mgKOH/g) | 0 | 16 | 16 |
| Thickening agent (B) | MC | MC | MC |
| Content of oxyethylene group (mol/g) | 0 | 0 | 0 |

TABLE 3-continued

| | Comparative Example 2 | Comparative Example 3 | Comparative Example 4 |
|---|---|---|---|
| Addition amount of thickening agent (B) (parts by mass) (relative to 100 parts by mass of aqueous urethane resin (A)) | 2 | 0.008 | 40 |
| Viscosity of aqueous urethane resin composition after thickening (mPa · s) | 650 | 327 | 957 |
| Coagulation bath (C) | | | |
| Metal salt (c-1) | Calcium nitrate | Calcium nitrate | Calcium nitrate |
| Forming state of porous structure in urethane resin layer | C | C | C |
| Touch feeling of synthetic leather | — | D | D |

Descriptions will be given for the abbreviations in Tables 1 to 3.

"ALA": "Borch Gel ALA" manufactured by Borchers Inc., sodium salt of polyacrylic acid "MC": Methyl cellulose "L75N": "Borch Gel L75N" by Borchers Inc. (containing a reaction product of 1,6-hexane diisocyanate, polyethylene glycol with the number average molecular weight of 3,000, and polyethylene glycol with the number average molecular weight of 6,000, polyoxyethylene distyrenated phenyl ether, acetylene glycol, and water (content ratio: 50% by mass), content of oxyethylene group: $1.6\times10^{-2}$ mol/g)

"T10": "ASSISTOR T10" manufactured by DIC Corporation (containing a reaction product of 1,6-hexane diisocyanate and polyethylene glycol with the number average molecular weight of 6,000, polyoxyethylene distyrenated phenyl ether, and water (content ratio: 75% by mass), content of oxyethylene group: $2.1\times10^{-2}$ mol/g).

It was found that the synthetic leather of the present invention has excellent touch feeling. It was also found that a porous structure or vertically long cells can be conveniently formed by using the aqueous urethane resin composition.

On the other hand, with respect to Comparative Example 1 that is an embodiment in which, instead of the thickening agent (B), a thickening agent having an oxyethylene group content which is higher than the range defined in the present invention is used, it has been found that the porous structure was not formed in the obtained urethane resin layer and also the synthetic leather had poor touch feeling.

With respect to Comparative Example 2 that is an embodiment in which a nonionic urethane resin having no acid value is used instead of the aqueous urethane resin (A), the resin was not coagulated.

With respect to Comparative Example 3 that is an embodiment in which the amount of the thickening agent (B) used is lower than the range defined in the present invention, it has been found that the obtained coagulated product does not form a porous structure. Further, a desired thickening effect was not obtained, and the coating property was very poor so that it was extremely difficult to prepare a uniform coating film. Further, the obtained synthetic leather had poor touch feeling.

With respect to Comparative Example 4 that is an embodiment in which the amount of the thickening agent (B) used is higher than the range defined in the present invention, it has been found that the obtained coagulated product does not form a porous structure. Further, the obtained synthetic leather had poor touch feeling.

The invention claimed is:

1. A method for manufacturing synthetic leather in which, after obtaining a thickened liquid by adding a thickening agent (B) with an oxyethylene group content of $2\times10^{-2}$ mol/g or less to an aqueous urethane resin composition containing an aqueous urethane resin (A) having an acid value of 0.01 mgKOH/g or higher, the thickening agent (B) being added in a range of 0.01 to 30 parts by mass relative to 100 parts by mass of the aqueous urethane resin (A), the thickened liquid is coated on a base and coagulated in a coagulation bath (C) containing a metal salt (c-1), wherein the metal salt (c-1) is calcium nitrate, and no heating is used to coagulate the thickened liquid.

2. The method for manufacturing synthetic leather according to claim 1, wherein the thickening agent (B) is one or more kinds selected from the group consisting of a cellulose thickening agent, an acryl thickening agent, and a urethane thickening agent.

* * * * *